US005250211A

United States Patent [19]

Motsenbocker

[11] Patent Number: 5,250,211

[45] Date of Patent: Oct. 5, 1993

[54] CLEANSER CONTAINING TSP, EDTA ETHYLENE GLYCOL BUTYL ETHER, AND ACETONE

[76] Inventor: Gregg Motsenbocker, 874 Felstar St., San Diego, Calif. 92109

[21] Appl. No.: 829,357

[22] Filed: Feb. 3, 1992

[51] Int. Cl.[5] ..... C11D 7/18; C11D 7/32; C11D 7/50; C11D 7/60

[52] U.S. Cl. ..... 252/99; 252/104; 252/135; 252/139; 252/153; 252/158; 252/173; 252/527; 252/546; 252/DIG. 14; 252/102

[58] Field of Search ..... 252/99, 104, 135, 139, 252/153, 158, 527, 546, DIG. 14, 102

[56] References Cited

U.S. PATENT DOCUMENTS

| | | | |
|---|---|---|---|
| 3,413,231 | 11/1968 | Kolodny | 252/171 |
| 3,607,760 | 9/1971 | McIntyre | 252/104 |
| 3,822,212 | 7/1974 | Bryant | 252/136 |
| 4,242,217 | 12/1980 | Westermann | 252/135 |
| 4,485,028 | 11/1984 | King | 252/99 |
| 4,774,015 | 9/1988 | Slover | 252/111 |
| 5,102,573 | 4/1992 | Han | 252/153 |

FOREIGN PATENT DOCUMENTS

| | | | |
|---|---|---|---|
| 59-202300 | 11/1984 | Japan | 252/139 |

*Primary Examiner*—Dennis Albrecht
*Attorney, Agent, or Firm*—Donald D. Mon

[57] ABSTRACT

A water-based cleanser containing TSP, ethylene diamine tetra acetic add (EDTA), ethylene glycol butyl ether (glycol EB) and acetone. Butyl salicylate can be used along with or in place of glycol EB. Optionally, hydrogen peroxide can be added to this cleanser to improve its action on some stains.

4 Claims, No Drawings

CLEANSER CONTAINING TSP, EDTA ETHYLENE GLYCOL BUTYL ETHER, AND ACETONE

FIELD OF THE INVENTION

Compositions to remove from surfaces such as carpets, cloth, hard surfaces, leather and suede, deleterious deposits and stains so as to restore them as closely as possible to a clean condition.

BACKGROUND OF THE INVENTION

Porous surfaces, such as those of carpets, clothing, tablecloths, napkins, automobile seats, athletic shoes, leather, suede, and certain metal and metal composites, to name only a few, and other hard surfaces such as tile, wallpaper and wood floors, often receive deleterious deposits and stains. Such deposits vary widely in their identity. Some may be quite viscous, for example paints, greases, and sauces such as mustard, catsup, and mayonnaise. Other are more liquid in nature, such as pet stains, wines, soft drinks, ball point inks, marker inks, fountain pen inks, and printers inks. Still others may be more solid or pasty, including foods, especially proteinaceous foods, water-based adhesives, and latex-based paint.

Some types of hard surfaces often have deposits respective to their storage and preservation. Examples are oily compositions to protect them from corrosion, residues from cutting oils for which a degreaser is needed, and dust on disc brakes which must be removed.

The above recitation exemplifies a broad range of materials which need to be cleaned from a broad range of deposits and stains. In response to this need, an equally wide range of cleaning compositions already exists in the market.

Generally speaking, commercial compositions are limited both in the range of their effectiveness, and also as to how efficient they really are for their intended purpose. If one intends to remove a wide range of kinds of deposits, he is likely to find a nearly-equal number of formulations to buy for the purpose. In addition, some of the stains and deposits are usually only partially removed, and with risk to the material being cleaned. On the consumer market today, for example, there is no known composition which will remove marking pen dye from a white tablecloth. This product will.

Furthermore, many existing compositions are objectionable from an environmental standpoint. This composition is water-based, and is environmentally acceptable.

It is an object of this invention to provide a water-based environmentally acceptable, biodegradable cleaning composition which can be used to remove a surprisingly large range of types of deposits and stains. Any residue of these compositions which might remain on the surface, or in the fabric underlying it, will not adversely affect the user or the surface to which it was applied. It has proved to be a considerable surprise to observe how many types of really difficult stains and deposits these compositions can remove, with little or no remaining evidence that there ever had been a stain or a deposit, or that the composition ever had been applied, all without damage to the material being cleaned.

It is another object to provide a small family of related compositions, which between them can attend to all but a few of the types of deposits and stains which predictably will be experienced.

BRIEF DESCRIPTION OF THE INVENTION

A composition according to this invention which provides a wide range of applications is water-based and comprises, in addition to water, tri-sodium phosphate, EDTA, glycol EB or butyl salicylate or a mixture of them, and acetone. This composition is surprisingly effective for the removal of beverage stains, pet stains, food stains and deposits, latex-based paints, proteins, dust, and corrosion preservatives.

The range of effectiveness of this composition can be greatly extended by the addition of hydrogen peroxide. When this is added, fluid inks, marker inks, and ball point inks, are decolorized, and are either removed or are rendered invisible, which for clothing achieves the desired stain removal.

According to an optional feature of the invention, the hydrogen peroxide is added to the basic formulation at the time of application, which provides for valuable extension of the active life ("shelf life") of the product ingredients, as well as augmental activity of the basic ingredients.

DETAILED DESCRIPTION OF THE INVENTION

The basic formulation of this invention, itself useful for cleaning a wide range of substrate materials from deposits and stains is an aqueous solution of trisodium phosphate ("TSP"), EDTA, glycol EB (ethylene glycol n-butyl ether) and/or butyl salicylate, and acetone. This solution is biodegradable, and is applicable to a wide range of materials without damaging them. It is best to wash it out after the solution has done its work—it does leave a small but usually unobjectionable deposit. The deposit is practically invisible on many surfaces and can be minimized by a proper selection of concentrations, especially of TSP. The components of the solution are benign, and if left in place will cause no damage to the substrate (soiled) material to which the solution is applied, nc)r to persons who come in contact with it.

Trisodium phosphate is a well-known cleaning composition. However, in many regions its usage is severely restricted by environmental laws and regulations. It is an advantage of this invention that in the lesser concentrations used in this invention it is acceptable under the most stringent existing laws and regulations. Still with the other components, it provides a very effective cleaning composition.

The combination of components used herein appears to function synergistically, by mechanisms which are not fully understood at this time. What has become apparent is that the total composition functions to a degree of effectiveness much greater than already-known compositions useful for the intended purposes, and that elimination of any of the components greatly reduces the effectiveness of the composition.

As a preliminary observation, it should be noted that purified water (either distilled, de-ionized or softened), is preferred. If it is used, the solution will be clear. If water is used which is not purified, then the solution is likely to be cloudy and sometimes less acceptable to the user. However, some users might actually prefer a cloudy or milky composition. Use of tap water will usually result in this.

The above basic formulation, for which more detailed specifications will be given below, is useful in cleaning automotive and hardware parts, including the functions of dust removal and degreasing. It is also effective to remove latex-based paints, to dissolve water based adhesives, to remove wall paper by dissolving adhesives that bond it to the wall, to remove beverages and their stains, and to remove protein based foods, sauces and condiments. It can be used on many substrates such as clothing, carpets, athletic shoes, wall, floors, wall papers, and many others.

In fact two of the most difficult food and beverage stains to remove are Kool-Aid and mustard. Conventional cleaners are nearly ineffective against these, while they are readily removed by this composition.

Some stains and deposits are more resistant to the basic formulation, usually because their dyes or other colorizers must be attended to either by decolorizing them, or by solubilizing them. Examples of these materials are fluid inks such as fountain pen inks, marker inks, and ball point inks. These are notoriously difficult to remove without damage to cloth, with the use of cleaning solutions generally available in a household, and with the skill and knowledge of the householder. Especially this is the situation where water-based formulations are needed. This invention provides excellent results without recourse to aromatic or petroleum solvents.

The modified formulation to be described can be directly applied to many troublesome stains and left there. The stain quickly disappears. Washing out the garment or blotting it is optional, but it is best practice to wash it out, or at least to blot it out. There will be no damage to any but the most fragile fabrics and none to many of such fabrics. The modified formulation is also useful for wood stripping, when some color removal is desired.

The ability of the basic formulation to remove ink and marker stains is improved by the addition of hydrogen peroxide to form the modified formulation. While the hydrogen peroxide may be mixed in with the basic formulation and sold as a product intended for these uses, this can lead to a shorter shelf life for the product. Preferred practice is to add the hydrogen peroxide to the basic formulation with which it is used at the time of application. Any suitable mixing technique, such as a mixing dispenser, or even dispensing from a container in which they are freshly mixed may be used.

The basic formulation is a solution consisting essentially of the following components, all by weight:

| | |
|---|---|
| Aqueous solution of trisodium phosphate, the ratio of TSP to water by weight being between about 12:1 to about 16:20 | 3 to 4 parts |

-continued

| | |
|---|---|
| Aqueous solution of EDTA, the ratio of EDTA to water by weight being about 0.5:3 | 3 to 5 parts |
| Glycol EB or butyl salicylite or a mixture of them | 2 parts |
| Acetone | 1 part |

The above basic formulation may be made into a "modified formulation" by the addition of between about 2 parts to about 4 parts of 3% hydrogen peroxide.

The presently preferred basic formulation is as follows:

3 parts of said TSP solution
3.5 parts of said EDTA solution
2 parts Glycol ED or butyl salicylate
1 part acetone.

The presently preferred modified formulation is the above basic formulation plus 2.5 parts of 3% hydrogen peroxide.

All components of the preferred formulation are in units as defined above.

Formulations according to this invention are remarkably versatile and effective for a wide range of deposits and stains on a wide range of substrates. Any residues can readily be removed, so that a clean surface remains. Any surface or substrate can be laundered or rinsed off to remove any residue.

This invention is not to be limited to the embodiments described in the description which are given by way of example and not of limitation, but only in accordance with the scope of the appended claims.

I claim:

1. A composition for restoring surfaces which had received deleterious deposits, consisting essentially of:

a. aqueous solution of tri-sodium phosphate (TSP), the ratio of TSP to water by weight being between about 12:1 to about 16:20–3 to 4 parts;
b. aqueous solution of, ethylene diamine tetra acetic acid (EDTA);
c. ethylene glycol n-butyl ether (glycol EB) or butyl salicylate, or a mixture of them—2 parts; and
d. acetone—1 part.

2. A modified composition comprising:

a. the composition of claim 1, and in addition, 2 to 4 parts of 3% hydrogen peroxide aqueous solution.

3. A composition according to claim 1, consisting of 2 parts of a; 3.5 parts of b; 2 parts of c; and 1 part of d.

4. A composition according to claim 3, in which 2.5 parts of 3% hydrogen peroxide aqueous solution are added.

* * * * *